US009318793B2

(12) United States Patent
Zhu et al.

(10) Patent No.: US 9,318,793 B2
(45) Date of Patent: Apr. 19, 2016

(54) CORNER BRACKET SLOT ANTENNAS

(75) Inventors: Jiang Zhu, Sunnyvale, CA (US); Qingxiang Li, Mountain View, CA (US); Robert W. Schlub, Cupertino, CA (US); Miroslav Samardzija, Mountain View, CA (US); Gordon Coutts, Sunnyvale, CA (US); Rodney A. Gomez Angulo, Sunnyvale, CA (US); Yi Jiang, Sunnyvale, CA (US); Boon W. Shiu, San Jose, CA (US); Salih Yarga, Sunnyvale, CA (US); Emily B. McMilin, Mountain View, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 413 days.

(21) Appl. No.: 13/462,268

(22) Filed: May 2, 2012

(65) Prior Publication Data

US 2013/0293424 A1 Nov. 7, 2013

(51) Int. Cl.

| | |
|---|---|
| ***H01Q 13/10*** | (2006.01) |
| ***H01Q 1/24*** | (2006.01) |
| ***H01Q 1/44*** | (2006.01) |

(52) U.S. Cl.

CPC ..... *H01Q 1/243* (2013.01); *H01Q 1/44* (2013.01); *H01Q 13/10* (2013.01)

(58) Field of Classification Search

CPC ..... H01Q 1/243; H01Q 1/44; H01Q 13/10

See application file for complete search history.

(56) References Cited

U.S. PATENT DOCUMENTS

| | | | |
|---|---|---|---|
| 3,573,834 | A | 4/1971 | McCabe et al. |
| 4,733,245 | A | 3/1988 | Mussler |
| 5,461,393 | A | 10/1995 | Gordon |
| 5,703,600 | A | 12/1997 | Burrell et al. |
| 5,768,217 | A | 6/1998 | Sonoda et al. |
| 5,872,557 | A | 2/1999 | Wiemer et al. |
| 5,877,728 | A | 3/1999 | Wu et al. |
| 5,914,693 | A | 6/1999 | Takei et al. |

(Continued)

FOREIGN PATENT DOCUMENTS

| | | | |
|---|---|---|---|
| CN | 1256802 | A | 6/2000 |
| CN | 1133237 | | 12/2003 |

(Continued)

OTHER PUBLICATIONS

Guterman et al., U.S. Appl. No. 13/490,356, filed Jun. 6, 2012.

*Primary Examiner* — Trinh Dinh

(74) *Attorney, Agent, or Firm* — Treyz Law Group, P.C.; G. Victor Treyz; Joseph F. Guihan

(57) ABSTRACT

A display cover layer may be mounted in an electronic device housing using housing structures such as corner brackets. A slot antenna may be formed from a corner bracket opening, metal traces on a hollow plastic support structure, or other conductive structures. The slot antenna may have a main portion with opposing ends. An antenna feed may be located at one of the ends. The slot antenna may have a slot with one or more bends. The bends may provide the slot antenna with a C-shaped outline. A side branch slot may extend from the main portion of the slot at a location between the two bends. The presence of the side branch slot may enhance antenna bandwidth. A hollow enclosure may serve as an antenna support structure and as a speaker box enclosing a speaker driver. The antenna feed may be positioned so as to overlap the speaker driver.

8 Claims, 11 Drawing Sheets

(56) References Cited

U.S. PATENT DOCUMENTS

| | | | | |
|---|---|---|---|---|
| 5,936,583 | A | 8/1999 | Sekine et al. | |
| 6,081,729 | A | 6/2000 | Bauerschmidt et al. | |
| 6,127,987 | A | 10/2000 | Maruyama et al. | |
| 6,225,959 | B1 | 5/2001 | Gordon | |
| 6,339,400 | B1 | 1/2002 | Flint et al. | |
| 6,344,825 | B1 | 2/2002 | Wong | |
| 6,380,930 | B1 | 4/2002 | Van Ruyumbeke | |
| 6,621,466 | B2 | 9/2003 | Kuck | |
| 6,642,892 | B2 | 11/2003 | Masaki et al. | |
| 6,646,605 | B2 | 11/2003 | McKinzie et al. | |
| 6,677,909 | B2 | 1/2004 | Sun et al. | |
| 6,831,607 | B2 | 12/2004 | Hebron et al. | |
| 6,859,186 | B2 | 2/2005 | Lizalek et al. | |
| 6,861,995 | B2 | 3/2005 | Kuo et al. | |
| 6,894,650 | B2 | 5/2005 | Darden et al. | |
| 6,985,361 | B2 | 1/2006 | Credelle et al. | |
| 7,075,782 | B2 | 7/2006 | Teshima | |
| 7,126,553 | B1 | 10/2006 | Fink et al. | |
| 7,199,756 | B2 | 4/2007 | Cha et al. | |
| 7,233,678 | B2 | 6/2007 | Erixon et al. | |
| 7,256,743 | B2 | 8/2007 | Korva | |
| 7,322,833 | B1 | 1/2008 | Hakansson et al. | |
| 7,342,539 | B2 | 3/2008 | Rosenberg et al. | |
| 7,345,634 | B2 | 3/2008 | Ozkar et al. | |
| 7,405,704 | B1 | 7/2008 | Lin et al. | |
| 7,446,729 | B2 | 11/2008 | Maruyama et al. | |
| 7,463,121 | B2 | 12/2008 | D'Ostilio | |
| 7,486,242 | B2 | 2/2009 | Gala Gala et al. | |
| 7,579,993 | B2 | 8/2009 | Lev et al. | |
| 7,629,930 | B2 | 12/2009 | Murch et al. | |
| 7,688,276 | B2 | 3/2010 | Quintero Illera et al. | |
| 7,710,331 | B2 | 5/2010 | Schillmeier et al. | |
| 7,804,453 | B2 | 9/2010 | Chiang et al. | |
| 8,054,232 | B2 | 11/2011 | Chiang et al. | |
| 8,059,039 | B2 * | 11/2011 | Ayala Vazquez et al. | 343/702 |
| 8,102,319 | B2 * | 1/2012 | Schlub et al. | 343/702 |
| 8,269,677 | B2 | 9/2012 | Guterman et al. | |
| 8,599,089 | B2 | 12/2013 | Bevelacqua et al. | |
| 8,638,549 | B2 | 1/2014 | Garelli et al. | |
| 8,766,858 | B2 | 7/2014 | Li et al. | |
| 8,773,310 | B2 * | 7/2014 | Shiu et al. | 343/700 MS |
| 2002/0149523 | A1 | 10/2002 | Fang et al. | |
| 2002/0171594 | A1 * | 11/2002 | Fang | 343/767 |
| 2003/0001780 | A1 | 1/2003 | Hill et al. | |
| 2003/0090426 | A1 | 5/2003 | Sun et al. | |
| 2003/0197648 | A1 | 10/2003 | Quinn et al. | |
| 2004/0051670 | A1 | 3/2004 | Sato | |
| 2004/0075611 | A1 | 4/2004 | Kenoun et al. | |
| 2004/0097270 | A1 | 5/2004 | Cha et al. | |
| 2004/0108960 | A1 * | 6/2004 | Kuo et al. | 343/767 |
| 2005/0017914 | A1 | 1/2005 | Huang | |
| 2005/0200535 | A1 | 9/2005 | Elkobi et al. | |
| 2006/0055618 | A1 | 3/2006 | Poilasne et al. | |
| 2006/0164315 | A1 * | 7/2006 | Munk | 343/776 |
| 2006/0227053 | A1 | 10/2006 | Ishikura | |
| 2006/0244663 | A1 | 11/2006 | Fleck et al. | |
| 2007/0057855 | A1 | 3/2007 | Mizoguchi et al. | |
| 2007/0115187 | A1 | 5/2007 | Zhang et al. | |
| 2007/0120740 | A1 | 5/2007 | Iellici et al. | |
| 2007/0176846 | A1 | 8/2007 | Vazquez et al. | |
| 2007/0202933 | A1 | 8/2007 | Tolbert et al. | |
| 2007/0216594 | A1 | 9/2007 | Uno et al. | |
| 2007/0262090 | A1 | 11/2007 | Ritsche | |
| 2007/0296592 | A1 | 12/2007 | Huang et al. | |
| 2008/0018551 | A1 | 1/2008 | Cheng et al. | |
| 2008/0316117 | A1 | 12/2008 | Hill et al. | |
| 2009/0067141 | A1 | 3/2009 | Dabov et al. | |
| 2009/0115683 | A1 | 5/2009 | Kurashima et al. | |
| 2009/0133825 | A1 | 5/2009 | Prat et al. | |
| 2009/0153412 | A1 | 6/2009 | Chiang et al. | |
| 2009/0174612 | A1 | 7/2009 | Ayala et al. | |
| 2009/0262029 | A1 | 10/2009 | Chiang et al. | |
| 2009/0265969 | A1 | 10/2009 | Nezu | |
| 2009/0295648 | A1 | 12/2009 | Dorsey et al. | |
| 2009/0315788 | A1 | 12/2009 | Hirota | |
| 2010/0060529 | A1 | 3/2010 | Schlub et al. | |
| 2010/0073241 | A1 * | 3/2010 | Ayala Vazquez et al. | 343/702 |
| 2010/0123632 | A1 | 5/2010 | Hill et al. | |
| 2010/0156741 | A1 | 6/2010 | Vazquez et al. | |
| 2010/0182205 | A1 | 7/2010 | Chiang | |
| 2010/0231481 | A1 | 9/2010 | Chiang et al. | |
| 2010/0321249 | A1 | 12/2010 | Chiang et al. | |
| 2010/0321253 | A1 | 12/2010 | Ayala Vazquez et al. | |
| 2010/0321325 | A1 | 12/2010 | Springer et al. | |
| 2011/0006953 | A1 | 1/2011 | Chiang et al. | |
| 2011/0025575 | A1 | 2/2011 | Niederkorn et al. | |
| 2011/0050508 | A1 | 3/2011 | Guterman et al. | |
| 2011/0050509 | A1 | 3/2011 | Ayala Vazquez et al. | |
| 2011/0111719 | A1 | 5/2011 | Man et al. | |
| 2011/0175790 | A1 * | 7/2011 | Yanagi et al. | 343/857 |
| 2011/0188179 | A1 * | 8/2011 | Myers | G06F 1/1626 361/679.01 |
| 2011/0241943 | A1 | 10/2011 | Shiu et al. | |
| 2011/0241948 | A1 * | 10/2011 | Bevelacqua et al. | 343/702 |
| 2011/0254745 | A1 | 10/2011 | Tsujimura et al. | |
| 2012/0026048 | A1 | 2/2012 | Vazquez et al. | |
| 2012/0068893 | A1 | 3/2012 | Guterman et al. | |
| 2012/0127040 | A1 | 5/2012 | Tang et al. | |
| 2012/0218695 | A1 | 8/2012 | Sakai | |
| 2012/0223865 | A1 | 9/2012 | Li et al. | |
| 2012/0223866 | A1 | 9/2012 | Ayala Vazquez et al. | |
| 2012/0280876 | A1 * | 11/2012 | Qu | 343/767 |
| 2013/0050032 | A1 * | 2/2013 | Shiu et al. | 343/702 |
| 2013/0057367 | A1 | 3/2013 | Smith | |
| 2013/0328730 | A1 | 12/2013 | Guterman et al. | |
| 2014/0009344 | A1 * | 1/2014 | Zhu et al. | 343/702 |
| 2014/0085161 | A1 * | 3/2014 | Zhu et al. | 343/867 |
| 2014/0086441 | A1 * | 3/2014 | Zhu et al. | 381/332 |
| 2014/0184453 | A1 * | 7/2014 | Chen et al. | 343/725 |
| 2014/0292591 | A1 | 10/2014 | Li et al. | |

FOREIGN PATENT DOCUMENTS

| | | |
|---|---|---|
| CN | 2850006 Y | 12/2006 |
| CN | 101068056 | 11/2007 |
| CN | 101276239 | 10/2008 |
| CN | 102255134 | 11/2011 |
| EP | 0543645 | 5/1993 |
| EP | 1329979 | 7/2003 |
| EP | 1329985 | 7/2003 |
| EP | 1868263 | 12/2007 |
| EP | 1950834 | 7/2008 |
| EP | 2034556 | 3/2009 |
| EP | 2110882 | 10/2009 |
| EP | 2128924 | 12/2009 |
| EP | 1483880 | 1/2010 |
| EP | 2495806 | 9/2012 |
| GB | 2437838 | 11/2007 |
| GB | 2485688 | 5/2012 |
| JP | HEI 09-083233 | 3/1997 |
| JP | 2003280815 | 10/2003 |
| JP | 2006048166 | 2/2006 |
| JP | 2007266822 | 10/2007 |
| JP | 2008306552 | 12/2008 |
| JP | 200935523 | 2/2009 |
| JP | 200965388 | 3/2009 |
| JP | 2009118027 | 5/2009 |
| JP | 2009290270 | 12/2009 |
| JP | 201010822 | 1/2010 |
| KR | 10-2004-0044211 | 5/2004 |
| KR | 10-2007-0016731 | 2/2007 |
| KR | 10-2010-0062539 | 6/2010 |
| TW | 201004024 | 1/2010 |
| WO | 9913526 | 3/1999 |
| WO | 99/36988 | 7/1999 |
| WO | 0215325 | 2/2002 |
| WO | 2007083500 | 7/2007 |
| WO | 2007135230 | 11/2007 |
| WO | 2012027024 | 3/2012 |

* cited by examiner

CORNER BRACKET SLOT ANTENNAS

BACKGROUND

This relates generally to electronic devices, and, more particularly, to antennas in electronic devices.

Electronic devices such as portable computers and handheld electronic devices are becoming increasingly popular. Devices such as these are often provided with wireless communications capabilities. For example, electronic devices may use long-range wireless communications circuitry to communicate using cellular telephone bands. Electronic devices may use short-range wireless communications links to handle communications with nearby equipment.

It can be difficult to incorporate antennas, audio components, and other electrical components successfully into an electronic device. Some electronic devices are manufactured with small form factors, so space for components is limited. In many electronic devices, the presence of conductive structures can influence the performance of electronic components such as antennas, further restricting potential mounting arrangements.

It would therefore be desirable to be able to provide improved ways in which to incorporate components such as antennas in electronic devices.

SUMMARY

An electronic device may have a housing in which one or more antennas may be formed. The electronic device may have a display with a display cover layer. The display cover layer may be mounted in the electronic device. Corner brackets may be located at the corners of the device to support the display cover layer.

A slot antenna may be used to handle wireless communications. The slot antenna may be formed from an opening in the corner bracket, patterned metal traces on a hollow plastic support structure, or other conductive structures. An antenna cavity for the slot antenna may be formed from traces on the plastic support structure or other cavity structures.

The slot antenna may have a main portion with opposing ends. An antenna feed may be located at one of the ends. The slot antenna may have a closed slot with one or more bends. The bends may provide the slot antenna with a C-shaped outline. A side branch slot may extend laterally outwards from the main portion of the slot at a location between the two bends and may operate as an open slot. The presence of the side branch slot may enhance antenna bandwidth. A hollow enclosure may serve as an antenna support structure and as a speaker box enclosing a speaker driver. The antenna feed may be positioned so as to overlap the speaker driver to minimize disruption to antenna performance due to the presence of the speaker driver.

Further features of the invention, its nature and various advantages will be more apparent from the accompanying drawings and the following detailed description of the preferred embodiments.

DETAILED DESCRIPTION

Electronic devices may be provided with antennas, audio components such as speakers, and other electronic components. It may be desirable to form some of these components in compact device configurations. For example, it may be desirable to form components for electronic devices using portions of housing structures, from structures that allow an antenna and another component to share mounting structures, and using antenna layouts that accommodate small form factor devices while exhibiting satisfactory wireless performance.

In some situations, it may be desirable to form conductive antenna structures that have slots. For example, slot antennas for cellular telephone communications, wireless local area network communications (e.g., WiFi® and Bluetooth® communications), and other wireless communications bands may be formed using conductive structures in which slot-shaped openings have been formed. To ensure that electronic components such as antenna and audio structures can be mounted satisfactorily within a desired device, slot-based antennas may be formed that are constructed as part of a structural housing element such as a corner bracket or other internal housing structure. Multiple slot arms may be included in a slot antenna to ensure sufficient wireless bandwidth. Some slot antenna structures may be mounted within a device in the vicinity of an electrical component such as a speaker having a speaker driver mounted in speaker box. These slot antenna structures may have a slot antenna feed that overlaps the speaker driver to minimize interference between the speaker and antenna.

Figure 1:
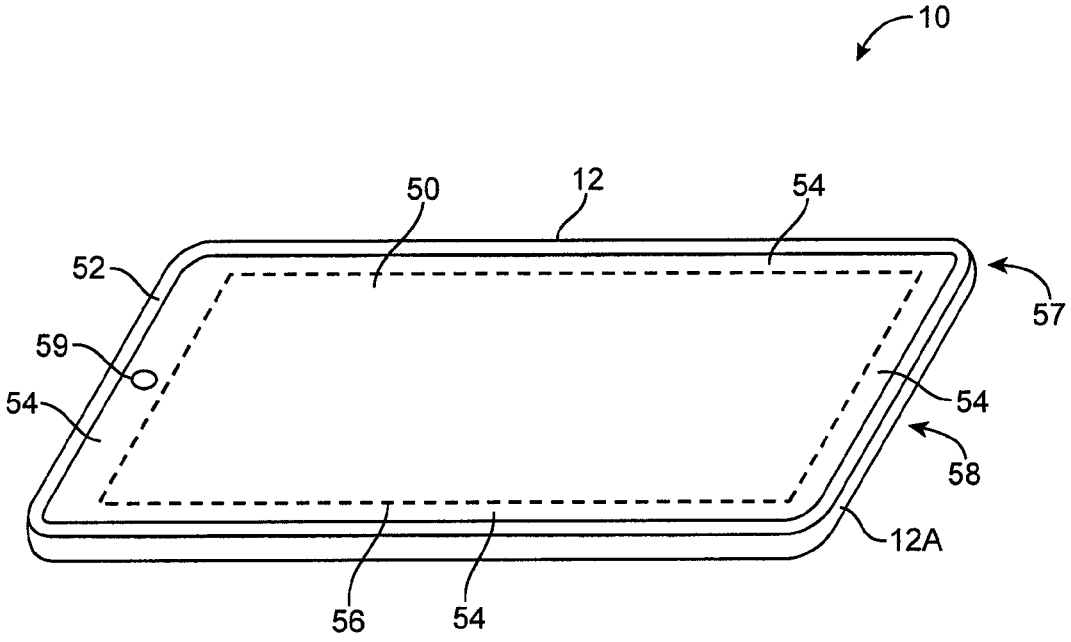
FIG. 1 is a front perspective view of an illustrative electronic device of the type that may be provided with antennas in accordance with an embodiment of the present invention.

An illustrative electronic device in which electronic component mounting schemes such as these may be used is shown in FIG. 1. Device 10 may include one or more antenna resonating elements, one or more speakers, one or more components that include antenna structures and speaker structures, and other electronic components. Illustrative arrangements in which an electronic device such as device 10 of FIG. 1 is provided with electronic components such as antenna structures and/or speaker structures that are formed from housing structures such as brackets, multi-arm slots, and slot antenna resonating elements with feeds that overlap speaker drivers are sometimes described herein as an example. In general, electronic devices may be provided with any suitable electronic components that include antenna structures. The electronic devices may be, for example, desktop computers, computers integrated into computer monitors, portable computers, tablet computers, handheld devices, cellular telephones, wristwatch devices, pendant devices, other small or miniature devices, televisions, set-top boxes, or other electronic equipment.

As shown in FIG. 1, device 10 may have a display such as display 50. Display 50 may be mounted on a front (top) surface of device 10 or may be mounted elsewhere in device 10. Device 10 may have a housing such as housing 12. Housing 12 may have curved portions that form the edges of device 10 and a relatively planar portion that forms the rear surface of device 10 (as an example). Housing 12 may also have other shapes, if desired.

Housing 12 may be formed from conductive materials such as metal (e.g., aluminum, stainless steel, etc.), carbon-fiber composite material or other fiber-based composites, glass, ceramic, plastic, other materials, or combinations of these materials. Antenna and speaker structures for device 10 may be formed along edges such as edge 58, at corners such as corner 57, or elsewhere within housing 12.

Device 10 may have user input-output devices such as button 59. Display 50 may be a touch screen display that is used in gathering user touch input. The surface of display 50 may be covered using a transparent dielectric member such as a planar cover glass member or a planar clear layer of plastic. The central portion of display 50 (shown as region 56 in FIG. 1) may be an active region that displays images and that is sensitive to touch input. The peripheral portion of display 50 such as region 54 may be an inactive region that is free from touch sensor electrodes and that does not display images.

A layer of material such as opaque ink, plastic, or other opaque masking layer material may be placed on the underside of display 50 in peripheral region 54 (e.g., on the underside of the display cover layer). This opaque masking layer may be transparent to radio-frequency signals. Conductive touch sensor electrodes in region 56 may tend to block radio-frequency signals. However, radio-frequency signals may pass through the display cover layer and the opaque layer in inactive display region 54 (as an example). Radio-frequency signals may, if desired, also pass through dielectric housing wall structures or other dielectric structures in device 10.

With one suitable arrangement, housing 12 may be formed from a metal such as aluminum. Portions of housing 12 may form ground structures (e.g., an antenna ground plane). Antenna ground structures may also be formed from traces on antenna support structures, metal tape, conductive fabric, printed circuit traces, and other conductive structures in device 10.

Figure 2:
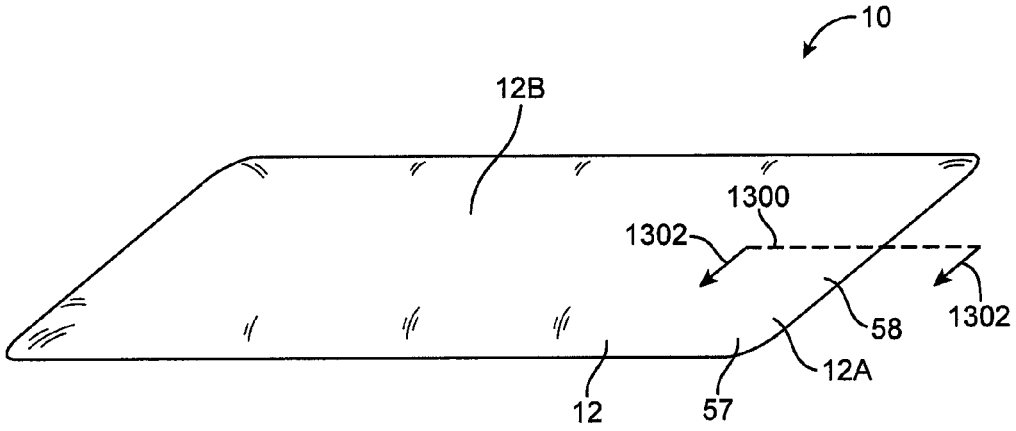
FIG. 2 is a rear perspective view of an illustrative electronic device such as the electronic device of FIG. 1 in accordance with an embodiment of the present invention.

FIG. 2 is a rear perspective view of device 10 of FIG. 1 showing how device 10 may have a relatively planar rear surface 12B. Antennas may be mounted within housing 12 along edges such as edge 58, at corners such as corner 57, or elsewhere within housing 12.

Figure 3:
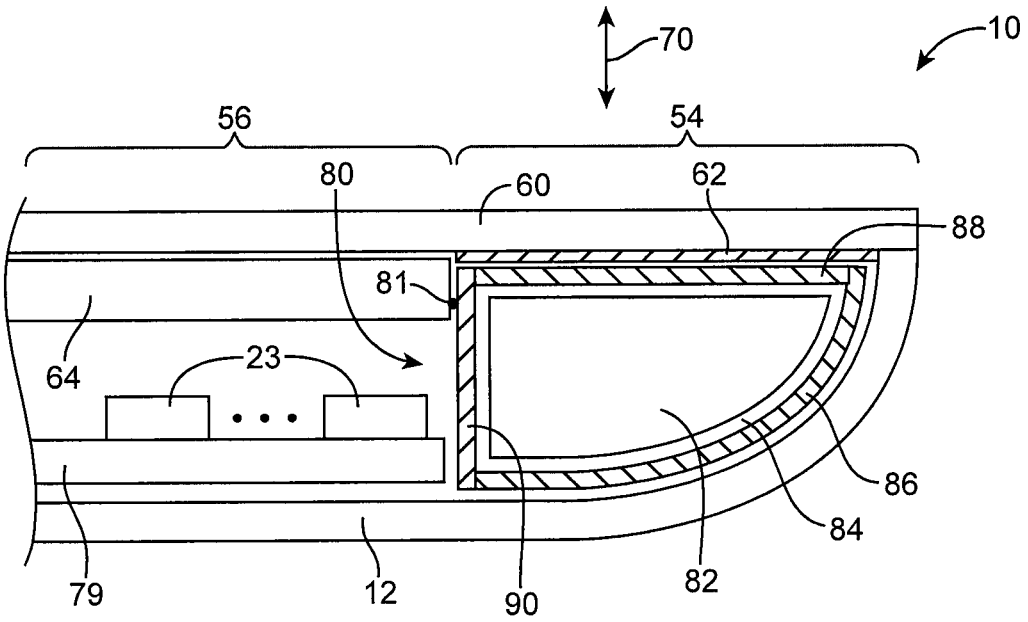
FIG. 3 is a cross-sectional side view of a portion of the electronic device of FIGS. 1 and 2 in accordance with an embodiment of the present invention.

A cross-sectional view of device 10 taken along line 1300 of FIG. 2 and viewed in direction 1302 is shown in FIG. 3. As shown in FIG. 3, antenna structures 80 for forming one or more antennas may be mounted within device 10 under display cover layer 60. Antenna structures 80 may include conductive material that forms an antenna resonating element for an antenna and antenna ground structures. Ground structures may also be formed from portions of housing 12 (e.g., metal portions of housing 12). An antenna in device 10 may be fed using a transmission line. The transmission line may have a positive signal conductor that is coupled to a positive antenna feed terminal and a ground signal conductor that is coupled to antenna ground (e.g., housing 12, antenna cavity walls, and other conductive ground structures) at a ground antenna feed terminal.

The antenna resonating element formed from structures 80 may be based on any suitable antenna resonating element design (e.g., structures 80 may form a patch antenna resonating element, a single arm inverted-F antenna structure, a dual-arm inverted-F antenna structure, other suitable multi-arm or single arm inverted-F antenna structures, a closed and/or open slot antenna structure, a loop antenna structure, a monopole, a dipole, a planar inverted-F antenna structure, a hybrid of any two or more of these designs, etc.). With one suitable arrangement, which may sometimes be described herein as an example, antenna structures 80 may be based on a slot antenna design with an optional antenna cavity (i.e., antenna structures 80 may form a cavity-backed slot antenna). Housing 12 and conductive structures in antenna structures 80 such as cavity sidewall structures may serve as antenna ground for an antenna formed from structure 80 and/or other conductive structures within device 10 may serve as ground (e.g., conductive components, traces on printed circuits, etc.).

As shown in FIG. 3, antenna structures 80 may include a dielectric antenna support such as support 84. Support 84 may be formed from a dielectric material such as plastic (polymer), glass, ceramic, or other dielectric materials. Support 84 may, as an example, be formed from injection molded plastic. Antenna support structures such as support structures 84 may be hollow. For example, support structures 84 may have relatively thin plastic walls that surround one or more air-filled cavities such as air-filled cavity 82 (as an example). Solid antenna support structures and antenna support structures with different types of interior structures may be used if desired.

Antenna structures 80 may be formed from conductive structures that are mounted adjacent to or on top of support structures 84. For example, antenna structures 80 may include conductive material such as conductive layers 86, 90, and 88 or other conductive structures. Conductive layers 86, 90, and 88 may be formed from layers of metal formed on the surfaces of support structures 84, from flexible or rigid printed circuits, conductive fabric, conductive foam, metal foil, metal formed on plastic parts using lasers and other tools, or other structures that are attached to support structures 84 using adhesive, from metal housing structures, from portions of electronic components, or other conductive structures. Structures 86 and 90 may form cavity walls for an antenna cavity (e.g., walls that form an open-toped box cavity that is covered by structures 88).

Structures 86 and 90 may be formed on support structure 84 by plating metal onto the surface of structure (as an example). If desired, structures 90 may be formed from a metal wall (e.g., a sheet of metal, a fabric layer, or a metal coating on structures 84). Solder, conductive foam, or other conductive material 81 may be used to ground structures 90 to display structures 64. Metal layer 88, which may form a ground plane (conductive plane) in which slot openings are formed for a slot antenna resonating element, may be formed from patterned metal traces on a planar upper surface of antenna support structures 84, from a flexible printed circuit or other printed circuit, from stamped metal foil, or from other conductive structures. If desired, other types of conductor arrangements may be used in forming the conductive materials for antenna structures 80. The illustrative configuration of FIG. 3 is merely illustrative.

During operation of the antenna formed from structures 80, radio-frequency antenna signals can be conveyed through a display cover member such as cover layer 60 in directions 70. Display cover layer 60 may be formed from one or more clear layers of glass, plastic, or other materials.

Display 50 may have an active region such as region 56 in which cover layer 60 has underlying conductive structure such as display panel module 64. The structures in display panel 64 such as touch sensor electrodes and active display pixel circuitry may be conductive and may therefore attenuate radio-frequency signals. In region 54, however, display 50 may be inactive (i.e., panel 64 may be absent). An opaque layer such as plastic or ink 62 may be formed on the underside of transparent cover glass 60 in region 54 to block the antenna resonating element that is formed from structures 88 from view by a user of device 10. Opaque material 62 and the dielectric material of cover layer 60 in region 54 may be sufficiently transparent to radio-frequency signals that radio-frequency signals can be conveyed through these structures in directions 70.

Device 10 may include one or more internal electrical components such as components 23. Components 23 may include storage and processing circuitry such as microprocessors, digital signal processors, application specific integrated circuits, memory chips, and other control circuitry. Components 23 may be mounted on one or more substrates such as substrate 79 (e.g., rigid printed circuit boards such as boards formed from fiberglass-filled epoxy, flexible printed circuits, molded plastic substrates, etc.). Components 23 may include input-output circuitry such as audio circuitry (e.g., circuitry for playing sound through speakers), sensor circuitry, button control circuitry, communications port circuitry, display circuitry, wireless circuitry such as radio-frequency transceiver circuitry (e.g., circuitry for cellular telephone communications, wireless local area network communications, satellite navigation system communications, near field communications, and other wireless communications), and other circuits. Connectors may be used in interconnecting circuitry 23 to transmission line paths. The transmission line paths may be used to route signals between the transceiver circuitry in components 23 and antenna structures 88.

Figure 4:
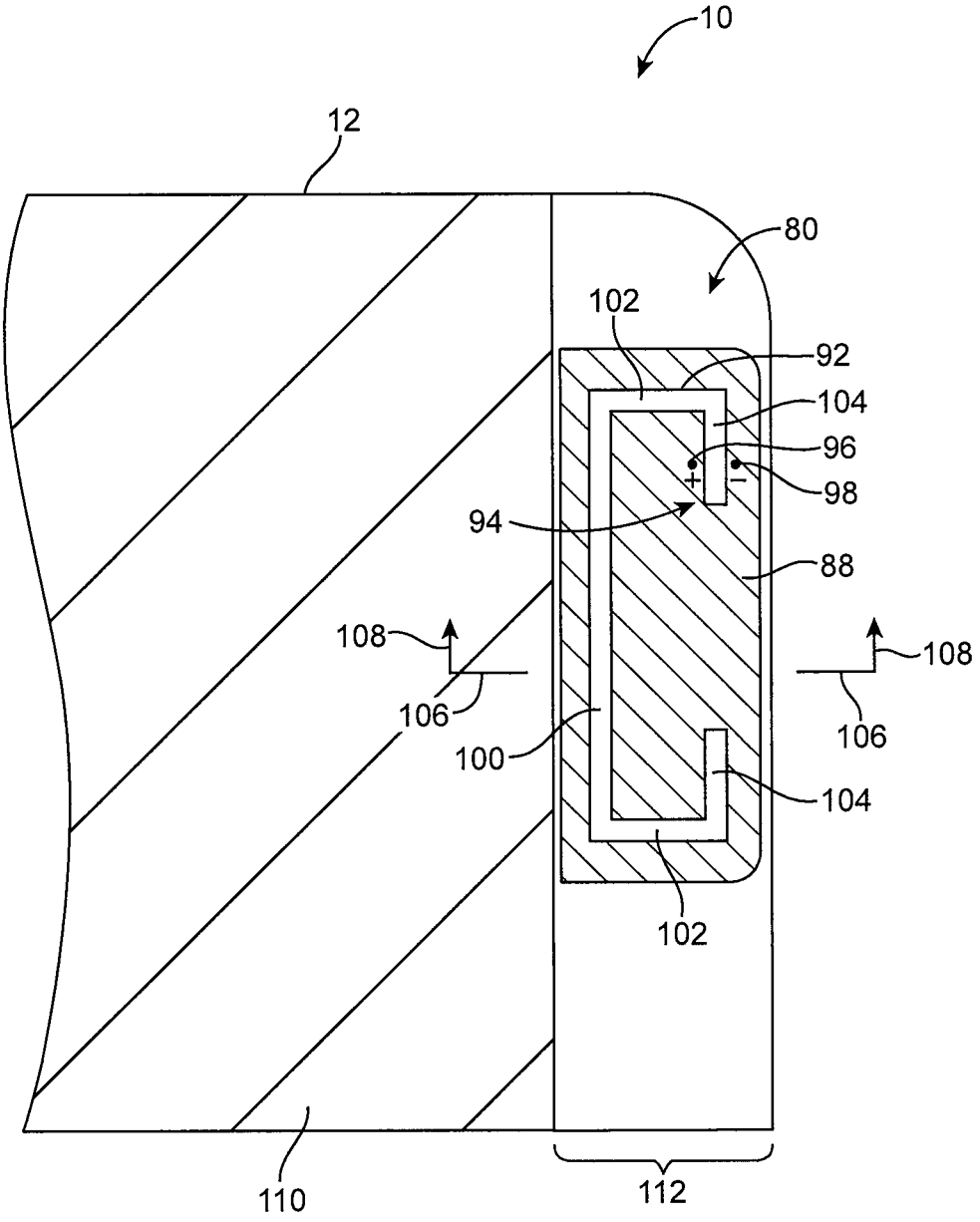
FIG. 4 is a top view of an illustrative electronic device with a slot antenna in accordance with an embodiment of the present invention.

FIG. 4 is a top view of a portion of electronic device 10 showing how antenna structures 80 may include conductive structures such as structures 88 (e.g., a ground plane or other planar conductive layer) having openings such as slot 92 for forming a slot antenna resonating element. Slot antenna resonating element 80 may be formed in edge portion 112 of device 10. Conductive structures 110 (e.g., a display, conductive portions of housing 12, etc.) may serve as antenna ground structures and may not overlap region 112 (as shown in FIG. 4). In general, antenna structures 80 may be formed in a corner of device 10, along an edge of device 10, or elsewhere in housing 12.

Slot 92 may have an inner perimeter (i.e., a perimeter that is about equal to twice the slot's length). The size of the inner perimeter may be configured to be substantially equal to one wavelength at a fundamental operating frequency of interest. Harmonics, cavity modes, and other factors may allow antenna 80 to cover additional frequencies of interest.

To help accommodate slot 92 within device 10, slot 92 may have a meandering path (e.g., a path with one or more bends). As an example, slot 92 may have a C-shape. With this type of configuration, slot 92 may have a main portion such as main segment 100 and one or more end portions (segments) such as perpendicular end branches 102. Slot 92 may also have end portions (segments) such as branches 104 that run parallel to main branch 100 at the opposing ends of the slot.

As shown in FIG. 4, slot antenna resonating element 80 may have an antenna feed such as feed 94. Antenna feed 94 may be located at one of the ends of slot 92. For example, antenna feed 94 may be formed on one of the end segments of slot 92 such as one of perpendicular segments 102 or one of parallel segments 104.

Figure 5:
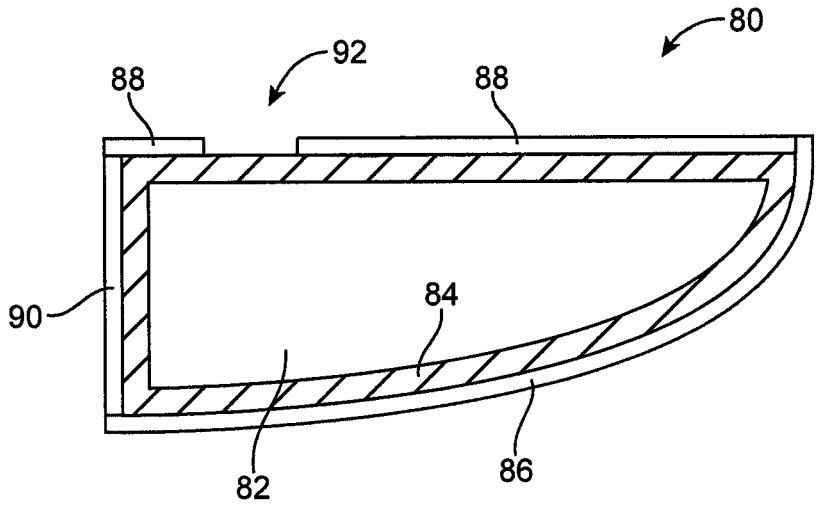
FIG. 5 is a cross-sectional side view of a slot antenna in accordance with an embodiment of the present invention.

A cross-sectional view of antenna structures 80 taken along line 106 and viewed in direction 108 of FIG. 4 is shown in FIG. 5. As shown in FIG. 5, antenna support structure 84 may be covered with metal layers or other conductive layers such as layers 88, 86, and 90. Layer 88 may have an opening such as antenna resonating element slot 92 for forming a slot antenna (antenna structures 80).

Figure 6:
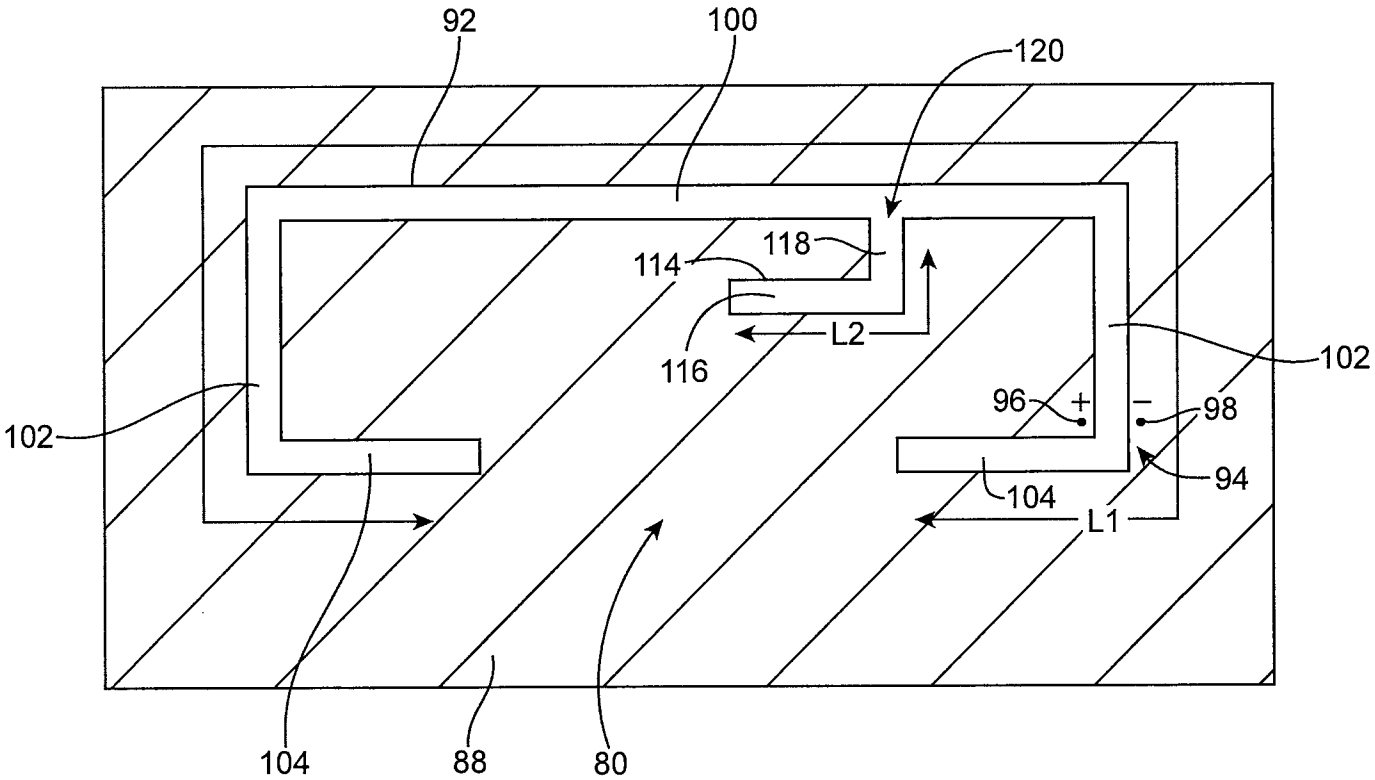
FIG. 6 is a top view of a slot antenna having a side branch arm that extends laterally outward from a central portion of a main slot at a location between opposing ends of the main slot in accordance with an embodiment of the present invention.

To ensure satisfactory bandwidth in desired communications bands during operation of slot antenna 80, slot antenna 80 may, if desired, be provided with additional branches. Consider, as an example, slot antenna 80 of FIG. 6. As shown in FIG. 6, slot antenna 80 may include conductive structures such as ground plane structures 88. Slot 92 may be formed in ground plane structures 88. Slot 92 may have a shape with straight sides, a shape with curved edges, a shape with a combination of curved and straight edges, shapes with one or more bends, angled sides, or other suitable layouts. In the example of FIG. 6, slot 92 has main segment 100, perpendicular end segments 102 at opposing ends of main segment 100, and parallel end segments 104 at opposing ends of slot 92. Antenna feed 94 may be located at one of the ends of slot 92. For example, antenna feed 94 may have a positive antenna feed terminal such as positive antenna feed terminal 96 and a ground antenna feed terminal such as ground antenna feed terminal 98 that are located on opposing sides of slot 92.

Slot 92 may be characterized by a length such as length L1. The width of slot 92 (i.e., the lateral dimension of slot 92 transverse to length L1), may be relatively small relative to length L1 (i.e., W may be a fifth of L1 or less, a tenth of L1 or less, etc.). In this type of configuration, the length L1 may be approximately one half of a wavelength at an operating frequency of interest. In addition to the main body of slot 92 (i.e., the rectangular slot of length L1 in the example of FIG. 6), slot 92 may have one or more side branches such as side branch 114. Branch 114 may have a rectangular slot shape, a rectangular shape with one or more bends (e.g., an L-shape of the type shown in FIG. 6), a shape with curved edges, a shape with straight and curved edges, or other suitable shapes. As shown in FIG. 6, for example, slot branch 114 may have a first segment such as segment 118 that extends perpendicularly to main segment 100 of slot 92 and a second segment such as end segment 116 that extends parallel to main segment 100 and perpendicular to segment 118.

The main body of slot 92 has closed ends 104, so a slot such as slot 92 of FIG. 6 may sometimes be referred to as a closed slot. If desired, slot 92 may be formed using an open slot configuration (i.e., a configuration in which one of the ends of slot 92 is open to dielectric material and is not covered by ground plane structures 88). An open slot antenna may exhibit a resonance at a frequency of operation at which its length is equal to a quarter of a wavelength. Side branch slot 116 may operate as an open slot. In particular, the tip of end 116 may be closed by virtue of being surrounded by ground plane structures 88, whereas branch 118 may have an open end such as end 120 at the juncture between branch 118 and segment 100 of branch 92. The length of slot 116 in the FIG. 6 example is L2, so slot 116 may exhibit a resonance at operating frequencies where L2 is equal to a quarter of a wavelength.

Figure 7:
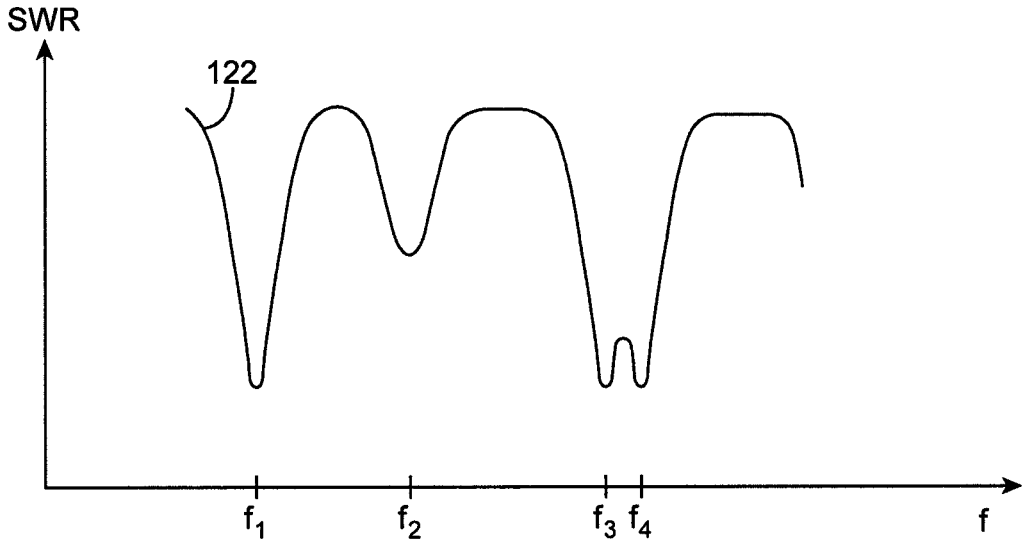
FIG. 7 is a graph in which antenna performance (standing wave ratio) has been plotted as a function of operating frequency for an illustrative slot antenna of the type shown in FIG. 6 in accordance with an embodiment of the present invention.

Side branch slot 114 may help to broaden the frequency response of antenna 80. An illustrative graph of antenna performance for an antenna such as antenna 80 of FIG. 6 is shown in FIG. 7. In the graph of FIG. 7, antenna performance (standing wave ratio) has been plotted by as a function of operating frequency. As shown by antenna performance curve 122, antenna 80 may exhibit resonances at frequencies such as frequencies f1, f2, f3, and f4. The resonance at frequency f1 may be associated with a fundamental mode for slot 92 (i.e., a mode associated with length L1). The resonance at frequency f2 may be associated with a cavity mode for an antenna cavity formed from conductive structures 86 and 90 (e.g., conductive structures forming a box-shaped cavity for antenna 80). The resonance at frequency f3 may be associated with a harmonic of the fundamental slot resonance. The resonance at frequency f4 may be associated with length L2 of open-slot side branch 114 of FIG. 6.

Antenna structures 80 of FIG. 6 may be used in covering one or more communications bands of interest. As an example, the resonance at frequency f2 (or at frequency f1) may be used in covering a low communications band (e.g., a low band associated with a cellular telephone network or a local area network), whereas the resonances at frequencies f3 and f4 may be used in covering a high communications band (e.g., a high band associated with a cellular telephone network or a local area network). By contributing a broadening influence at frequency f4 to the antenna resonance at frequency f3, the presence of side slot 114 may help ensure that the resonance that spans the f3 and f4 frequencies is sufficiently broad to cover the desired high communications band.

Figure 8:
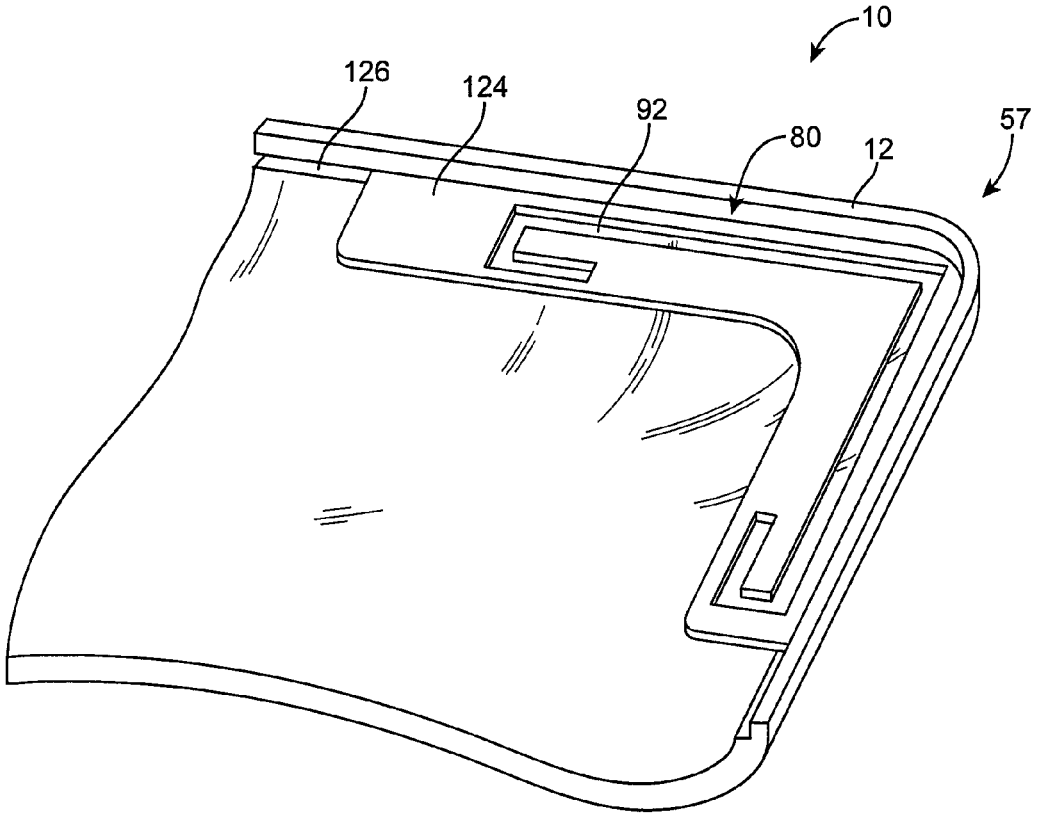
FIG. 8 is a perspective view of an electronic device housing having a corner bracket with a slot antenna in accordance with an embodiment of the present invention.

FIG. 8 is a perspective view of a portion of device 10 showing how antenna slot 92 may be formed in an internal housing structure such as metal corner bracket 124 at corner 57 of housing 12. Corner bracket 124 may have a planar upper surface that is configured to serve as a ledge on which display cover layer 60 may be mounted using adhesive or other fastening mechanisms. Bracket 124 may also have an opposing lower surface. A peripheral portion of the lower surface of bracket 124 may be attached to ledge 126 of housing 12 or other suitable housing structures. Adhesive, screws, welds, or other attachment mechanisms may be used in mounting bracket 124 to housing 12. If desired, slot 92 may be provided with one or more side branches such as open slot side branch 114 of slot 92 of FIG. 6. The presence of these additional side branches may help to broaden the bandwidth of antenna 80 in one or more communications bands of interest.

Figure 9:
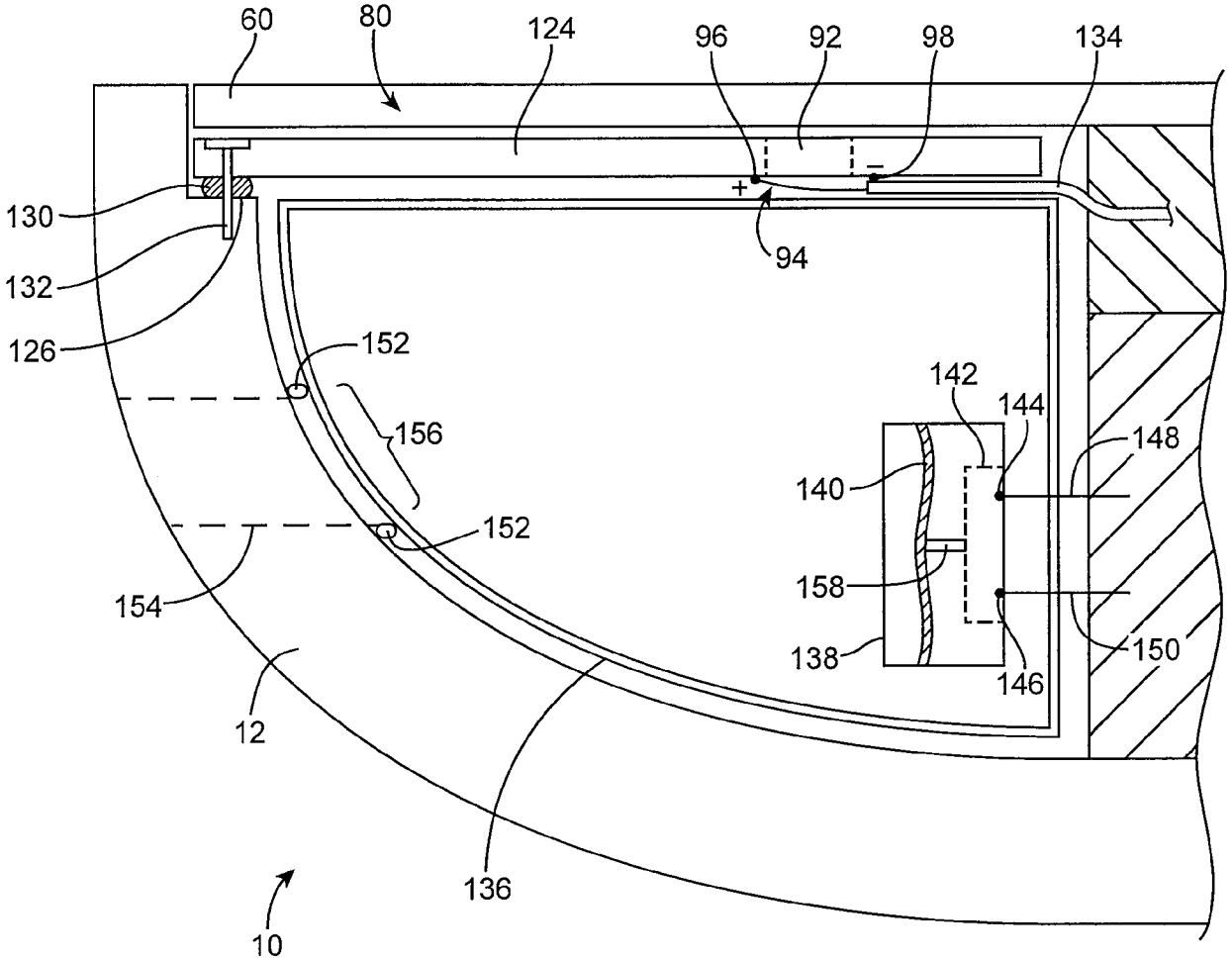
FIG. 9 is a cross-sectional side view of a portion of an electronic device containing an illustrative slot antenna and an enclosure that may serve as both an antenna cavity support structure and as a speaker box in accordance with an embodiment of the present invention.

A cross-sectional side view of device 10 in the vicinity of antenna structures 80 that include a slot such as slot 92 in housing structure 124 is shown in FIG. 9. Housing structure 124 may be a corner bracket, a bracket or other support structure that is located along an edge of housing 12, or other structure located in the interior of device 10 or formed as part of housing 12. Structure 124 may be formed from a conductive material such as metal. Antenna feed 94 may include a positive antenna feed terminal such as antenna feed terminal 96 and a ground antenna feed terminal such as antenna feed terminal 98. Antenna feed terminals 96 and 98 may be formed on opposing sides of slot 92.

A transmission line such as transmission line 134 may be coupled to antenna feed 94. Antenna feed 94 may be located at one of the ends of slot 92 to help impedance match transmission line 134 and antenna 80. Transmission line 134 may have a positive signal conductor that is coupled to positive antenna feed terminal 96 and a ground signal conductor that is coupled to ground antenna feed terminal 98. Transmission line 134 may be formed from a coaxial cable, a flexible printed circuit with signal line traces, a microstrip transmission line structure, a stripline transmission line structure, or other transmission line structure. Transmission line 134 may be used in conveying signals between antenna 80 and radio-frequency transceiver circuitry in components 23 (FIG. 3). If desired, circuitry such as filters, switches, impedance matching circuits, and other circuits may be interposed in the transmission line path between components 23 and antenna 80.

Display cover layer 60 may be supported by the upper surface of bracket 124. Adhesive may be used to attach display cover layer 60 to bracket 124, if desired. Screws such as screw 132 and/or adhesive 130 or other attachment mechanisms may be used in attaching bracket 124 to housing 12.

If desired, some of the interior volume of device 10 may be used to form a cavity for cavity antenna 80 while simultaneously being used to form a speaker box (speaker cavity) for a speaker. As shown in FIG. 9, for example, bracket 124 may be mounted above enclosure 136. Conductive layers may be formed on enclosure 136 such as cavity layers 86 and 90 of FIG. 3. This allows enclosure 136 to serve as a support structure for an antenna cavity for antenna 80. Hollow dielectric support structure 136 may have a planar surface that faces a display layer.

Enclosure 136 may also contain a speaker driver such as speaker driver 138. Speaker driver 138 may include an actuator such as actuator 142 (e.g., a solenoid or other electromechanical actuator). Actuator 142 may be coupled to diaphragm 140 by support structure 158. Audio signals may be provided to driver terminals 144 and 146 by signal lines 148 and 150, respectively. When it is desired to play sound for a user of device 10, the signals that are provided to driver 142 via the signal path formed from lines 148 and 150 can be used to cause actuator 142 to move diaphragm 140. The movement of diaphragm 140 creates sound that may pass through the port formed by opening 156 in enclosure 136 and opening 154 in housing 12.

If desired, antenna 80 of FIG. 9 may include a slot such as slot 92 that is formed in ground plane structure 88 formed from patterned metal traces on the upper surface of enclosure (support structure 136). The configuration of FIG. 9 in which slot 92 has been formed in bracket 124 is merely illustrative.

Figure 10:
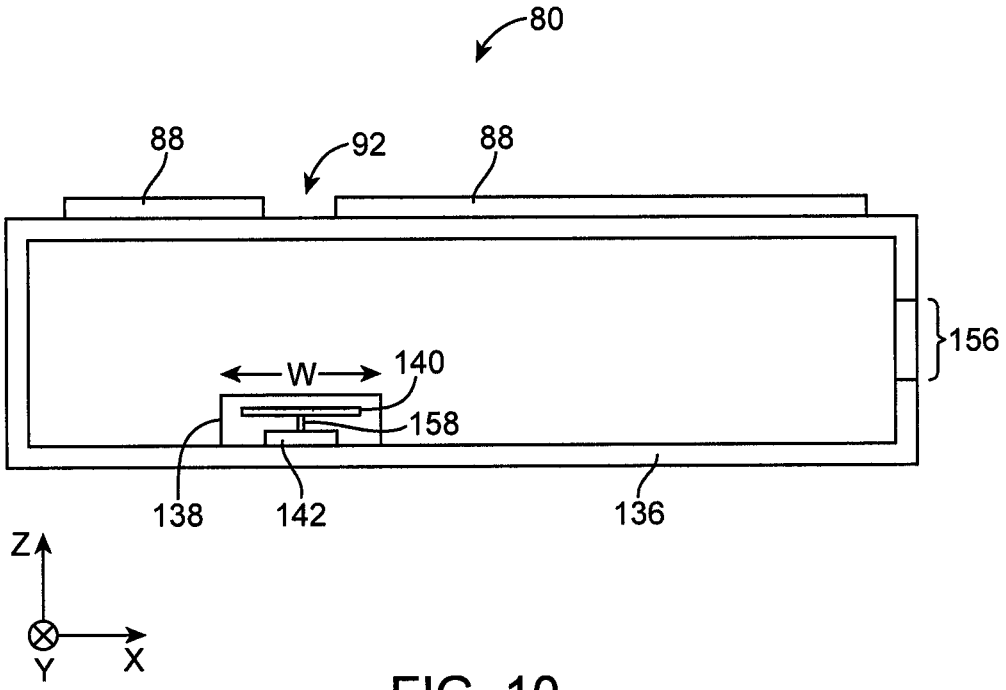
FIG. 10 is a cross-sectional side view of a speaker box containing a speaker driver that overlaps a slot antenna feed in accordance with an embodiment of the present invention.

FIG. 10 is a cross-sectional view of antenna structures 80 showing how slot 92 may be configure to overlap speaker driver 138. Speaker driver 136 may be characterized by dimensions such as maximum dimension W. Maximum dimension W may be, for example, the width of speaker driver 136 in horizontal dimension X or horizontal dimension Y or may be the height of speaker driver 136 in dimension Z (as examples). As shown in FIG. 10, for example, speaker driver 138 may have a maximum width W in horizontal dimension X.

The size of speaker driver 138 may serve as a metric for measuring the location of antenna feed 94 relative to speaker driver 138. Speaker driver 138 may contain conductive components such as metal parts associated with actuator 158 and other structures. Electric field strength associated with the operation of antenna 80 may be minimized in the vicinity of end of slot 92 and therefore the antenna feed at the end of slot 92. It may therefore be desirable to locate the feed for antenna 80 (i.e., the end of the slot) in the vicinity of speaker driver 138, so as not to disrupt antenna operation with the presence of metal structures in speaker driver 138. The feed for antenna 80 (and the end of the slot) may be considered to be located in the vicinity of driver 138 when the feed (e.g., both of the feed terminals in the feed) or slot end falls within a radius of W, 2W, or 3W of speaker driver 138 (as examples).

Figure 11:
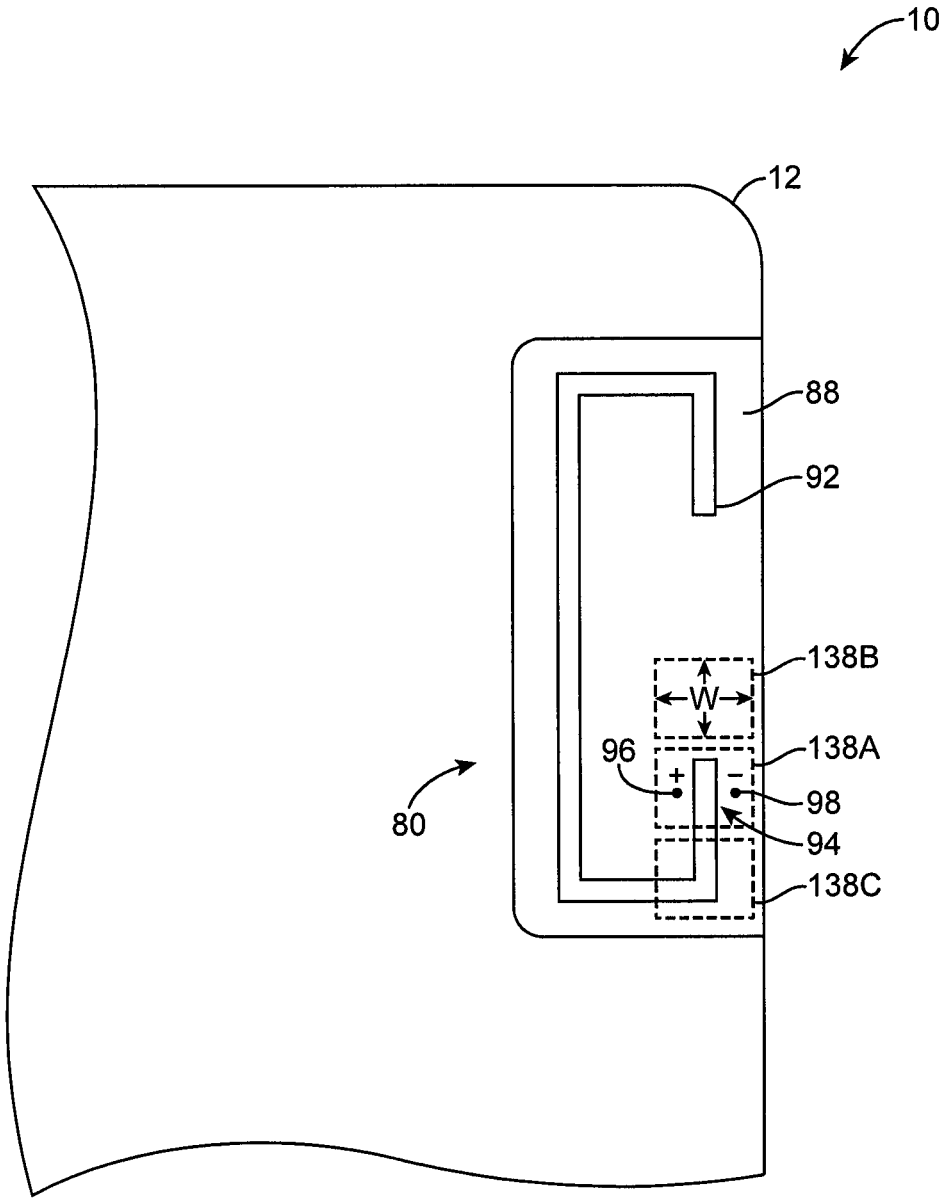
FIG. 11 is a top view of an edge portion of an electronic device having a speaker with a speaker driver that is located in the vicinity of a slot antenna feed in accordance with an embodiment of the present invention.

A top view of a portion of electronic device 10 showing how antenna feed 94 may be configured to overlap speaker driver 138 (or otherwise be located in the vicinity of speaker driver 138). As shown in FIG. 11, antenna feed 94 may be located directly above speaker driver 138 (see, e.g., speaker driver location 138A) or may be located in the vicinity of speaker driver 138 without overlapping speaker driver 138 (see, e.g., speaker driver locations 138B and 138C). In general, disruption of antenna 80 may be minimized by locating feed 94 (or the slot end) so that at least part of feed 94 (or the slot end) overlaps the footprint (X-Y area) of speaker driver 138, may be minimized by locating feed 94 (or the slot end) so that at least part of feed 94 (or the slot end) overlaps at least part of a circle of radius 2W centered on speaker driver 138, or may be minimized by locating feed 94 (or the slot end) so that at least part of feed 94 (or the slot end) overlaps at least part of a circle of radius 3W centered on speaker driver 138 (as examples). Other feed (or the slot end) locations may be used if desired. These feed (or the slot end) locations for antenna structures 80 are merely illustrative.

The foregoing is merely illustrative of the principles of this invention and various modifications can be made by those skilled in the art without departing from the scope and spirit of the invention.

What is claimed is:

1. Apparatus having front and rear surfaces, comprising:

a display layer at the front surface;

a housing having a rear housing portion at the rear surface and an edge portion that extends between the rear housing portion and the display layer;

a hollow dielectric support structure between the display layer and the rear housing portion, the hollow dielectric support structure having a planar surface that faces the display layer;

a slot antenna formed from a slot in a conductive layer that is interposed between the planar surface of the hollow dielectric support structure and the display layer, wherein the slot has opposing ends and the slot antenna has an antenna feed at one of the ends; and a speaker driver in the hollow dielectric support structure, wherein the slot antenna is configured so that the antenna feed overlaps the speaker driver, and sound created by the speaker driver passes through an opening in the edge portion of the housing.

2. The apparatus defined in claim 1, wherein the slot comprises a C-shaped slot.

3. The apparatus defined in claim 1 wherein the conductive layer comprises metal traces on the hollow dielectric support structure.

4. The apparatus defined in claim 3, wherein the metal traces are configured to form an antenna cavity for the slot antenna.

5. The apparatus defined in claim 1, wherein the slot comprises a main portion and a side branch that branches from the main portion at a location between the ends.

6. The apparatus defined in claim 1, wherein the slot comprises a C-shaped slot.

7. The apparatus defined in claim 1, wherein the speaker driver is located directly underneath the antenna feed.

8. The apparatus defined in claim 1, wherein the slot antenna has at least one bend.

* * * * *